United States Patent [19]

Dubinsky

[11] 4,010,980

[45] Mar. 8, 1977

[54] COVERS FOR OUTDOOR CHAIRS

[76] Inventor: Emanuel Dubinsky, 99 Kingston Ave., Yonkers, N.Y. 10701

[22] Filed: Jan. 3, 1975

[21] Appl. No.: 538,455

[52] U.S. Cl. ..... 297/441; 160/371; 297/457

[51] Int. Cl.[2] ..... A47C 7/00

[58] Field of Search ..... 5/110, 111, 112, 114, 5/186, 187, 191; 160/327, 371; 297/441, 452, 457, 218

[56] References Cited

UNITED STATES PATENTS

| | | | |
|---|---|---|---|
| 1,391,362 | 9/1921 | Bickel | 297/441 X |
| 1,807,478 | 5/1931 | Isaacson | 297/441 X |
| 3,512,834 | 5/1970 | Lockshin | 297/441 |
| 3,667,532 | 6/1972 | Kurz | 297/452 X |

*Primary Examiner*—James C. Mitchell

[57] ABSTRACT

A cover is used as a replacement for outdoor chairs and chaises, for restoring them and also for the manufacture of new units. In case of a chair having horizontal tubular vinyl straps extending across the back and the seat, the cover of the present invention consists of a top piece, elongated fairly wide straps and narrower straps for attaching the wide straps. The top piece is tubular and has opposed edges adapted to be closed by a zipper. The top piece is intended to be placed upon the top frame portion of the chair. The straps have ends firmly attached to the top piece. The wide straps are combined with the horizontal vinyl straps by extending over a few horizontal straps, then under the following straps, then again over some straps and so on. The narrower straps extend behind the chair and are used for attaching the wider straps. A substantially similar construction may be used for chairs having wide horizontal straps instead of the tubular straps.

3 Claims, 5 Drawing Figures

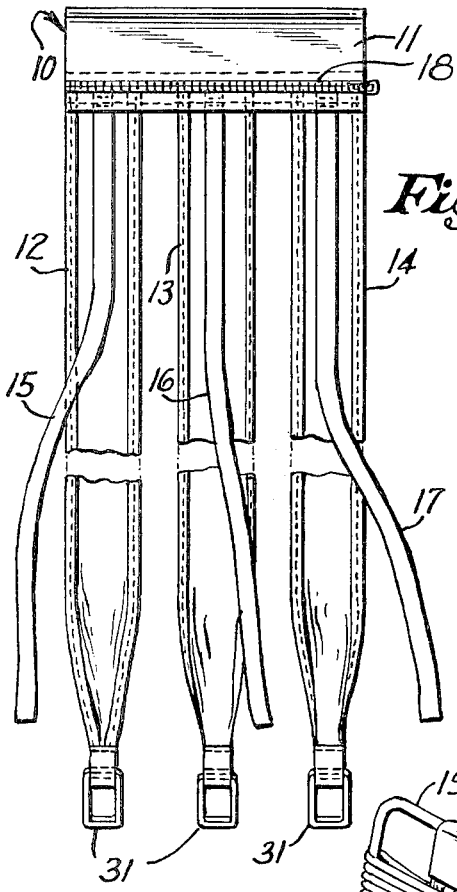
Fig.1
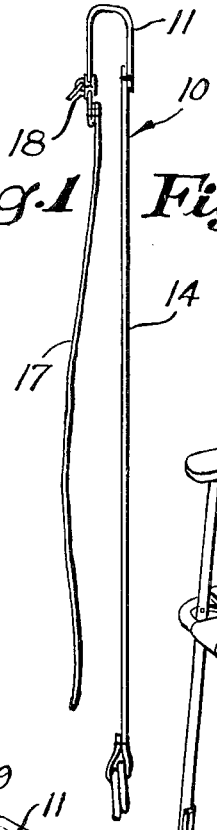
Fig.2
Fig.4
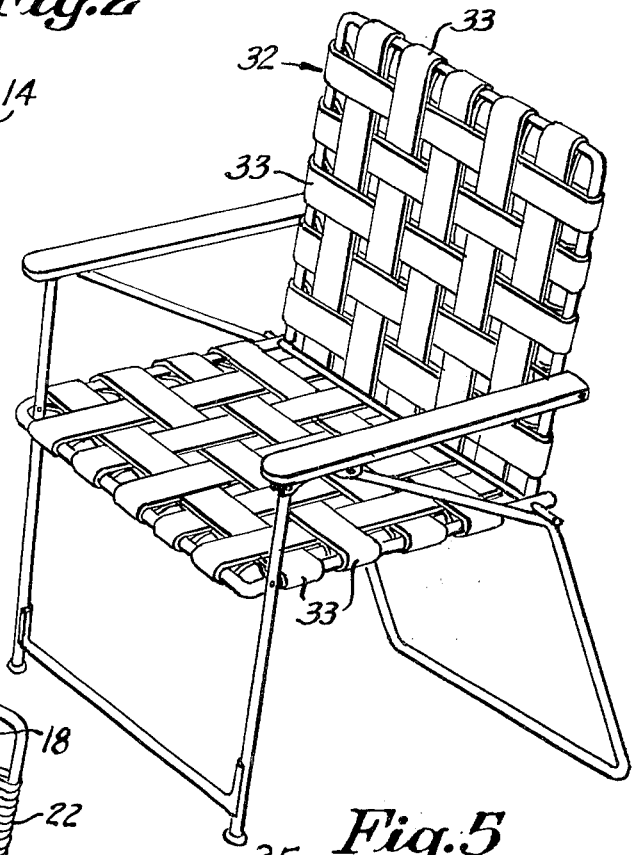
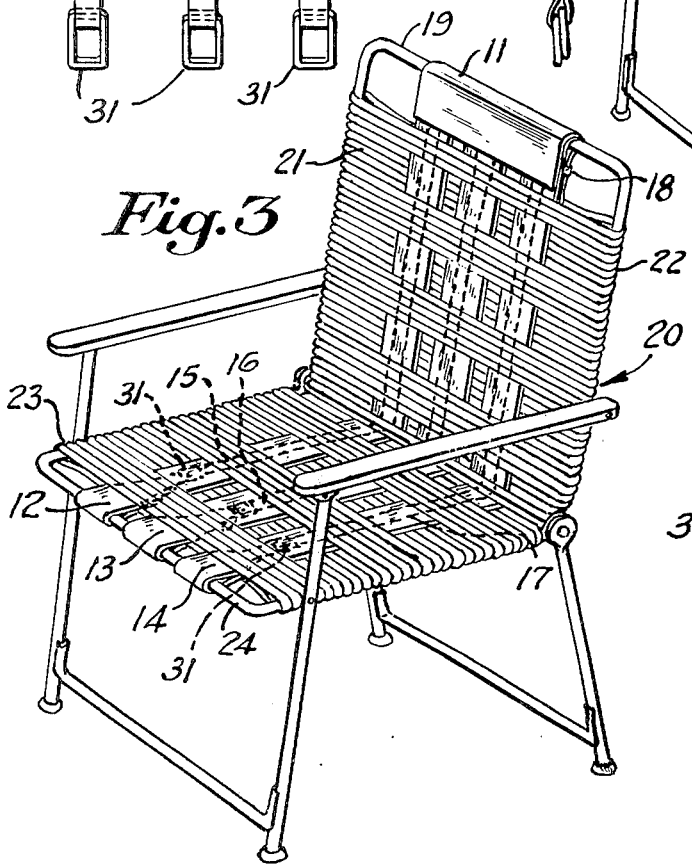
Fig.3
Fig.5
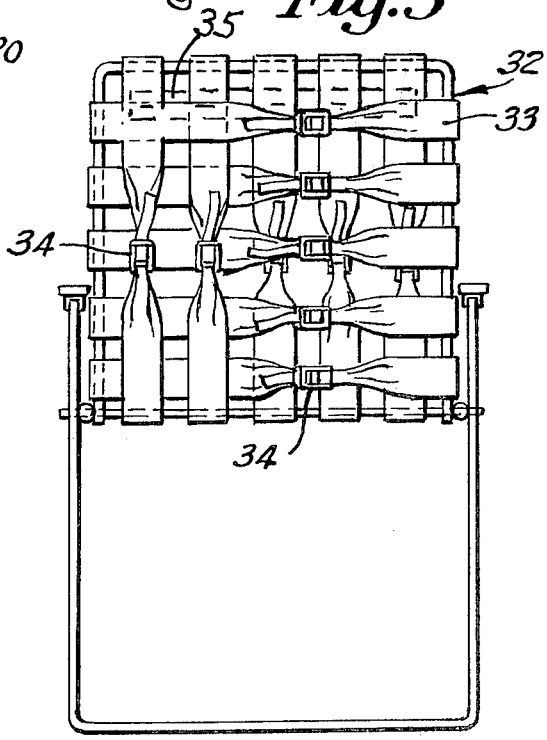

COVERS FOR OUTDOOR CHAIRS

SUMMARY OF THE INVENTION

Heretofore, outdoor chairs have been restored and new ones manufactured by the sole use of vinyl tubing. This was found to be unsatisfactory, since the stretching of vinyl may cause a deep and uncomfortable sag for the user. The tubular straps may separate or break, with the result that the user will partially fall through.

An object of the present invention is to avoid the drawbacks of existing chair covers.

Another object is the provision of a chair cover which can be easily and quickly placed upon a chair and removed without the use of any tools, which will extend the effective duration of a chair and which, by the use of different colors, will enhance the appearance of a chair.

Other objects will become apparent in the course of the following specification.

For a chair having horizontal tubular straps, the objects of the present invention may be realized by the provision of a cover consisting of interconnected pieces, namely, a top piece having a tubular shape and adapted to extend over the top frame portion of the chair and to be joined by a zipper. Ends of elongated straps are sewn to the top piece. These straps consist of wider straps and narrower straps. The wider straps are combined with the horizontal tubular straps by extending over a few tubular straps, then under the next few straps and so forth until all tubular straps of the back and seat are used in this manner. The narrower straps are located behind the wider straps. They extend behind the chair and have ends connected to the ends of the wider straps to provide proper fixing of the entire structure. The ends may be connected by grommets or, preferably, by strap and buckle devices.

According to another embodiment of the invention, the tubular straps are eliminated and are replaced by horizontal straps of the same width as the wide vertically extending straps. Then the ends of all straps are individually joined, and the use of the tubular top piece may be eliminated.

DESCRIPTION OF THE DRAWINGS

The invention will appear more clearly from the following detailed description when taken in connection with the accompanying drawings, showing, by way of example only, preferred embodiments of the inventive idea.

In the drawing:

FIG. 1 is a rear view of a chair cover.

FIG. 2 is a side view of the same chair cover.

FIG. 3 is a perspective view of a chair provided with a cover shown in FIGS. 1 and 2.

FIG. 4 is a perspective view of a chair having a different cover.

FIG. 5 is a rear view of the chair shown in FIG. 4.

DETAILED DESCRIPTION OF THE EMBODIMENTS

The chair cover 10 shown in FIGS. 1 and 3 consists of a top piece 11, wider straps 12, 13 and 14, and narrower straps 15, 16 and 17. The cover can be made of any suitable fabric, preferably cotton duck or vinyl laminated nylon. The top piece 11 has the shape of an elongated tube and its opposed ends are joined by a zipper 18.

As shown in FIG. 3, the top piece 11 is placed over the top frame portion 19 of a chair 20 and is then fixed by actuating the zipper 18.

The chair 20 has a plurality of horizontal tubular vinyl straps 21 of the usual type extending horizontally across the back 22 of the chair and across the seat 23. The straps 21 extend around the frame 24 of the chair and are fixed to the frame by means well know in the art. They extend parallel to each other with narrow spaces being provided between two adjacent straps.

In the illustrated embodiment, three wide straps 12, 13 and 14, have ends sewn to an edge of the piece 11. Three narrow straps 15, 16 and 17 are also sewn by their ends to the under part of the piece 11. Each narrow strap is located substantially in the middle of a wider strap.

Obviously, the number of the straps may vary, depending upon the width of the chair.

After the top piece 11 has been attached, the wide straps are connected to the chair by a weaving motion, namely, the user first takes the wide strap 12, moves it under a few tubular straps 21, then pulls the strap 12 outwardly through the space between two adjacent straps 21, then extends the strap 12 over a few straps 21, then pulls the strap 12 inwardly, extends it behind a few adjacent straps, 21, then pulls the strap 12 outwardly agains and continues this operation until the strap 12 reaches the last outer straps 21 of the seat.

Then the user carries out the same procedure with the strap 13, and then with the strap 14. Obviously, these straps can extend over the same tubular straps 21 or over different straps, thereby creating different designs in the chair.

The ends of the wide straps 12, 13 and 14 are held in place by being attached to the ends of narrow straps 15, 16 and 17 respectively. This is accomplished by extending the narrow straps behind the back and the seat of the chair and then connecting them with the wider straps by buckle devices 31 carried by the ends of the wide straps. These buckle devices are of the usual type; they are self-tightening, so that they can provide a tight connection of the cover upon the chair.

Obviously, grommets or pressure rings can be used for the same purpose.

It is apparent that the holding straps 15, 16 and 17 are essentially concealed from view.

It is also apparent that the application of the cover of the present invention to a chair is a quick and simple procedure and can be carried out by persons with limited skills. The use of adjustable buckle devices makes it possible to apply a cover of the same size to chairs of different sizes. The cover can be easily cleaned and replaced. It can be used for new chairs as well as for worn out chairs. Covers of different colors can be used to provide different color effects.

FIGS. 4 and 5 show a different embodiment, namely a chair 32 which consists entirely of wide straps 33. These straps extend partly over each other to provide a weaving appearance. Each strap has its ends connected behind the chair by a buckle device 34.

Since no tubular straps are provided, the use of a top piece is eliminated.

A zipper-carrying horizontal straps 35 extends under the straps 33 and is connected behind all vertical straps. The advantage of this straps 35 is that it distributes the point of stress to two separate locations, one location being the zipper and the other location being that of the buckle on the vertical strap.

Another advantage of the zipper-strap 35 is that it secures the vertical straps in place and prevents their shifting.

The general advantage of the complete wrap around straps is that there is no longer a wearing out at the locations where screws or metal clips were used heretofore.

I claim:

1. In a horizontal vinyl-like tubular covered chair having a frame having a seat portion and a back portion and having a plurality of originally installed vinyl-like horizontal tubular straps extending around said frame across said back and seat portions thereof and fixed to said frame, said oringinally installed horinzontal tubular straps extending parallel to each other with spaces between adjacent oringinally installed horizontal tubular straps; the improvement comprising a removable cover for reinforcing and enhancing the effective duration of said oringinally installed horizontal vinyl-like tubular covering for said chair, said removable cover comprising a tubular top piece removably mountable over the top of said frame back portion, said removable cover top piece comprising a pair of opposed front and rear separable portions removably connectable together to fix said top piece about said frame back portion top and a zipper means thereon for removably connecting said top piece separable portions together about said frame back portion top, said removable cover further comprising a first plurality of spaced apart parallel straps having a width greater than the width of said originally installed horizontal tubular straps and vertically extending from said removable cover top piece front portion and a second plurality of spaced apart parallel straps having a width narrower than said straps of said first plurality and vertically extending from said removable cover top piece rear portion, said first and second plurality of vertically extending straps being equal in number and being disposed on said respective front and rear portions with a respective corresponding strap of said second plurality substantially coaxial with a respective strap of said first plurality, each of said straps of said first plurality having an adjustable self-tightening tension means at the free end thereof in which the free end of said corresponding respective strap of said second plurality is removably interlockable, each of said first plurality of vertically extending straps being weavably threadable through selected ones of said originally installed horizontal tubular straps and lockable in place by interlocking with said corresponding strap of said second plurality behind said frame seat portion for reinforcing said originally installed horizontal tubular straps.

2. A removable cover for reinforcing and enhancing the effective duration of originally installed horizontal vinyl-like tubular covering for a horizontally vinyl-like tubular covered chair having a frame having a seat portion and a back portion and having a plurality of originally installed vinyl-like horizontal tubular straps extending around said frame across said back and seat portions thereof and fixed to said frame, said originally installed horizontal tubular straps extending parallel to each other with spaces between adjacent originally installed horizontal tubular straps; said removable cover comprising a tubular top piece removably mountable over the top of said frame back portion, said removable cover top piece comprising a pair of opposed front and rear separable portions removably connectable together to fix said top piece about said frame back portion top and a zipper means thereon for removably connecting said top piece separable portions together about said frame back portion top, said removable cover further comprising a first plurality of spaced apart parallel straps having a width greater than the width of said originally installed horizontal tubular straps and vertically extending from said removable cover top piece front portion and a second plurality of spaced apart parallel straps having a width narrower than said straps of said first plurality and vertically extending from said removable cover top piece rear portion, said first and second plurality of vertically extending straps being equal in number and being disposed on said respective front and rear portions with a respective corresponding strap of said second plurality substantially coaxial with a respective strap of said first plurality, each of said straps of said first plurality having an adjustable self-tightening tension means at the free end thereof in which the free end of said corresponding respective strap of said second plurality is removably interlockable, each of said first plurality of vertically extending straps being weavably threadable through selected ones of said originally installed horizontal tubular straps and lockable in place by interlocking with said corresponding strap of said second plurality behind said frame seat portion for reinforcing said originally installed horizontal tubular straps.

3. A removable cover for a chair having a frame having a seat portion and a back portion, said cover comprising a first plurality of horizontal straps extendable about said frame, each of said horizontal straps having separable and interlockable first and second ends with one of said ends having an adjustable tension self-tightening means thereat in with said other end is removably interlockable for adjusting the tension of said interlocked horizontal strap and holding said tension at a desired level, said first plurality of horizontal straps extending parallel to each other with spaces between adjacent horizontal straps, a second plurality of vertical straps extending over the top of said frame back portion and the bottom of said frame seat portion, each of said vertical straps extending over some of said horizontal straps and under some other of said horizontal straps in a woven-like configuration, the extension of one of said vertical straps over one of said horizontal straps following its extension under the next horizontal strap, each of said vertical straps having separable and interlockable first and second ends with one of said ends having an adjustable tension self-tightening means thereat in which said other end is removably interlockable for adjusting the tension of said interlocked vertical strap and holding said tension at a desired level, and a zipper means extending horizontally across said second plurality of vertical straps and secured to one of said first plurality of horizontal straps for distributing the point of stress on said vertical straps to both said zipper means which secures said vertical straps in spaced apart position in said removably mounted cover on said frame and to said vertical strap self-tightening means, said zipper means comprising a tape which holds said vertical straps in said spaced apart position and a zipper closure for stressing said vertical straps, both said horizontal and vertical strap self-tightening tension means interlocking said respective strap ends behind said frame to secure said cover to said frame in position for covering said back and seat of said chair.

* * * * *